US008086122B2

(12) United States Patent
Nakane

(10) Patent No.: US 8,086,122 B2
(45) Date of Patent: Dec. 27, 2011

(54) IMAGE FORMING APPARATUS, IMAGE ADJUSTING METHOD

(75) Inventor: Naomi Nakane, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1121 days.

(21) Appl. No.: 11/618,061

(22) Filed: Dec. 29, 2006

(65) Prior Publication Data

US 2008/0159763 A1 Jul. 3, 2008

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS

| | | | | |
|---|---|---|---|---|
| 5,493,321 | A * | 2/1996 | Zwadlo | 399/49 X |
| 2005/0141907 | A1* | 6/2005 | Izumikawa et al. | 399/49 |
| 2005/0175365 | A1* | 8/2005 | Gomi | 399/49 |

FOREIGN PATENT DOCUMENTS

| | | | |
|---|---|---|---|
| JP | 11-136532 | | 5/1999 |
| JP | 2006011205 | A * | 1/2006 |

* cited by examiner

*Primary Examiner* — David Gray
*Assistant Examiner* — Erika J Villaluna
(74) *Attorney, Agent, or Firm* — Turocy & Watson, LLP

(57) ABSTRACT

A technique that can stably realize highly accurate image adjustment processing even when unexpected toner density unevenness occurs on an identical sheet because of fluctuation in an image formation characteristic and the like is provided.

An image forming apparatus that forms, on a sheet, a test pattern formed by a color obtained by mixing colors of toners of plural colors, reads a test pattern image formed on the sheet with a color sensor, and performs predetermined image adjustment processing on the basis of information read includes a halftone-image forming unit configured to form, on the sheet, at least one of a first halftone image extending over a predetermined range in a main scanning direction and a second halftone image extending over a predetermined range in a sub-scanning direction, an image reading unit configured to read the halftone image formed on the sheet by the halftone-image forming unit, a density-unevenness determining unit configured to determine, on the basis of information read by the image reading unit, toner density unevenness in an image formed by the image forming apparatus, an image-adjustment processing unit configured to perform the predetermined image adjustment processing on the basis of the density unevenness determined, and a color sensor that is arranged on a downstream side of a fixing device in a sheet conveyance direction and reads the test pattern formed on the sheet.

13 Claims, 9 Drawing Sheets

IMAGE FORMING APPARATUS, IMAGE ADJUSTING METHOD

BACKGROUND OF THE INVENTION

1. Field of the Invention

The present invention relates to an image adjustment processing in an image forming apparatus, and, more particularly to improvement of accuracy of image adjustment processing.

2. Description of the Related Art

In recent years, color MFPs are becoming increasingly popular year by year. In particular, since office documents are prepared in color, an increasing number of color copies and prints are used. In the case of the color MFPs, it is more important to always keep colors and densities constant. However, in general, a density characteristic of a printer engine tends to change as time elapses. Thus, some the color MFPs have a function for gamma automatic adjustment (calibration) to keep colors and gradations as constant as possible.

Specifically, the gamma automatic adjustment is a function of outputting, in general, a pattern of a regular gradation, inputting the pattern with a scanner, calculating an inverse function or the like from a read value, and setting a gamma correction curve for adjusting an output image quality.

A gray section other than characters of a copy and a print image is often formed by four colors of Y/M/C/K. However, in this gray section, since a balance of the respective colors is lost because of aged deterioration and a difference among machines, the gray changes to colored gray, which looks extremely unattractive. When the gray balance is lost in this way, conventionally, it is possible to adjust the gray balance using a function of color balance adjustment or the like. However, this takes time because the adjustment is manual adjustment. Further, even if the gray balance is adjusted with effort, a printer gamma characteristic (an image formation characteristic) fluctuates due to aged deterioration. Thus, the gray balance has to be adjusted every time the printer gamma characteristic fluctuates, which is extremely complicated.

Moreover, even if the gray balance is successfully corrected in this way, when unexpected density unevenness of a toner image occurs on an identical sheet, it is extremely difficult to perform image adjustment. There is a problem in that it is impossible to accurately correct the gray balance even if automatic adjustment is performed in this state.

SUMMARY OF THE INVENTION

It is an object of an embodiment of the invention to provide a technique that can stably realize highly accurate image adjustment processing even when unexpected toner density unevenness occurs on an identical sheet because of fluctuation in an image formation characteristic and the like.

In order to solve the problems, an image forming apparatus according to an aspect of the invention is an image forming apparatus that forms, on a sheet, a test pattern formed by a color obtained by mixing colors of toners of plural colors, reads a test pattern image formed on the sheet with a color sensor, and performs predetermined image adjustment processing on the basis of information read. The image forming apparatus includes a halftone-image forming unit configured to form, on the sheet, at least one of a first halftone image extending over a predetermined range in a main scanning direction and a second halftone image extending over a predetermined range in a sub-scanning direction, an image reading unit configured to read the halftone image formed on the sheet by the halftone-image forming unit, a density-unevenness determining unit configured to determine, on the basis of information read by the image reading unit, toner density unevenness in an image formed by the image forming apparatus, an image-adjustment processing unit configured to perform the predetermined image adjustment processing on the basis of the density unevenness determined by the density-unevenness determining unit, and a color sensor that is arranged on a downstream side of a fixing device in a sheet conveyance direction and reads the test pattern formed on the sheet.

An image forming apparatus according to an aspect of the invention is an image forming apparatus that forms a test pattern on a sheet and performs predetermined image adjustment processing on the basis of a print state of the test pattern formed. The image forming apparatus includes a halftone-image forming unit configured to form, on the sheet, at least one of a first halftone image extending over a predetermined range in a main scanning direction and a second halftone image extending over a predetermined range in a sub-scanning direction, an image reading unit configured to read the halftone image formed on the sheet by the halftone-image forming unit, a density-unevenness determining unit configured to determine, on the basis of information read by the image reading unit, toner density unevenness in an image formed by the image forming apparatus, and an image-adjustment processing unit configured to perform the predetermined image adjustment processing on the basis of the density unevenness determined by the density-unevenness determining unit.

An image forming apparatus according to an aspect of the invention is an image forming apparatus that forms a test pattern on a sheet and performs predetermined image adjustment processing on the basis of a print state of the test pattern formed. The image forming apparatus includes halftone-image forming means for forming, on the sheet, at least one of a first halftone image extending over a predetermined range in a main scanning direction and a second halftone image extending over a predetermined range in a sub-scanning direction, image reading means for reading the halftone image formed on the sheet by the halftone-image forming means, density-unevenness determining means for determining, on the basis of information read by the image reading means, toner density unevenness in an image formed by the image forming apparatus, and image-adjustment processing means for performing the predetermined image adjustment processing on the basis of the density unevenness determined by the density-unevenness determining means.

An image adjusting method according to an aspect of the invention is an image adjusting method in an image forming apparatus that forms a test pattern on a sheet and performs predetermined image adjustment processing on the basis of a print state of the test pattern formed. The image adjusting method includes the steps of forming, on the sheet, at least one of a first halftone image extending over a predetermined range in a main scanning direction and a second halftone image extending over a predetermined range in a sub-scanning direction, reading the halftone image formed on the sheet in the halftone image forming step, determining, on the basis of information read in the image reading step, toner density unevenness in an image formed by the image forming apparatus, and performing the predetermined image adjustment processing on the basis of the density unevenness determined in the density-unevenness determining step.

DESCRIPTION OF THE EMBODIMENT

An embodiment of the invention will be hereinafter explained with reference to the drawings.

Figure 1:
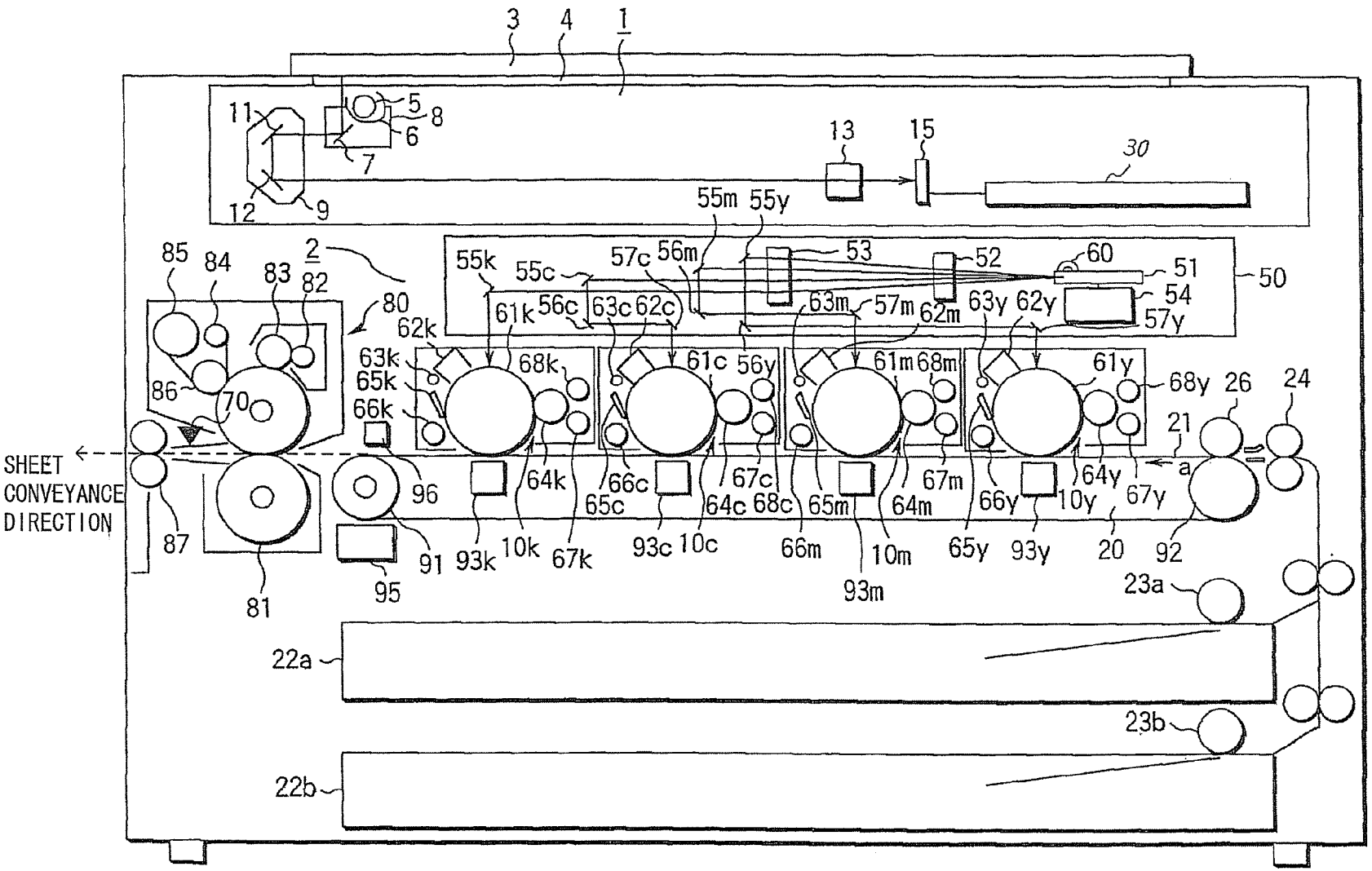
FIG. 1 is a diagram schematically showing an internal structure of an image forming apparatus such as a digital color copying machine that forms a duplicate image of a color image according to an embodiment of the invention.

FIG. 1 schematically shows an internal structure of an image forming apparatus such as a digital color copying machine that forms a duplicate image of a color image according to this embodiment. Roughly speaking, this image forming apparatus includes a color scanner unit 1 serving as image reading means that reads a color image on an original and a color printer unit 2 serving as image forming means that forms a duplicate image of the color image read.

The color scanner unit 1 has an original stand cover 3 in an upper part thereof and has an original stand 4 that is disposed to be opposed to the original stand cover 3 in a closed state and is made of a transparent glass on which an original is set. Under the original stand 4, an exposure lamp 5 that illuminates the original placed on the original stand 4, a reflector 6 for condensing light from the exposure lamp 5 on the original, a first mirror 7 that bends reflected light from the original in a left direction with respect to the surface of the figure, and the like are disposed. The exposure lamp 5, the reflector 6, and the first mirror 7 are fixed to a first carriage 8. The first carriage 8 is driven by a not-shown pulse motor to be moved in parallel along the lower surface of the original stand 4.

On the left side in the figure with respect to the first carriage 8, i.e., in a direction in which light reflected by the first mirror 7 is guided, a second carriage 9 provided to be movable in parallel to the original stand 4 via a not-shown driving mechanism (e.g., a toothed belt and a DC motor) is disposed. A second mirror 11 that bends the reflected light from the original guided by the first mirror 7 downward in the figure and a third mirror 12 that bends the reflected light from the second mirror 11 in the right direction in the figure are arranged at right angles to each other. The second carriage 9 is driven by the first carriage 8 and moved in parallel along the original stand 4 at speed a half of that of the carriage 8.

A focusing lens 13 that focuses the reflected light from the third mirror 12 at a predetermined magnification is arranged in a plane including an optical axis of the light returned by the second and the third mirrors 11 and 12. A CCD color image sensor (photoelectric conversion element) 15 that converts the reflected light imparted with a focusing property by the focusing lens 13 into electric signals is disposed in a place substantially orthogonal to an optical axis of light transmitted through the focusing lens 13.

Therefore, when the light from the exposure lamp 5 is condensed on the original on the original stand 4 by the reflector 6, the reflected light from the original is made incident on the color image sensor 15 via the first mirror 7, the second mirror 11, the third mirror 12, and the focusing lens 13. The incident light is converted into electric signals corresponding to the three primary colors of light, R (red), G (green), and B (blue), in the color image sensor 15.

The color printer unit 2 has first to fourth image forming units 10*y*, 10*m*, 10*c*, and 10*k* that form images subjected to color separation for respective color components on the basis of the known subtractive color mixture method, i.e., images of four colors, yellow (y), magenta (m), cyan (c), and black (k).

A conveying mechanism 20 including a conveyor belt 21 serving as conveying means that conveys images of respective colors formed by the respective image forming units in an arrow "a" direction in the figure is disposed below the respective image forming units 10*y*, 10*m*, 10*c*, and 10*k*. The conveyor belt 21 is wound around and tensed between a driving roller 91 rotated in the arrow "a" direction by a not-shown motor and a driven roller 92 spaced apart from the driving roller 91 by a predetermined distance. The conveyor belt 21 is endlessly moved in the arrow "a" direction at constant speed. The respective image forming units 10*y*, 10*m*, 10*c*, and 10*k* are disposed in series along a conveyance direction of the conveyor belt 21.

The respective image forming units 10*y*, 10*m*, 10*c*, and 10*k* include photoconductive drums 61*y*, 61*m*, 61*c*, and 61*k* serving as image bearing members, outer peripheral surfaces of which are formed to be rotatable in an identical direction in positions in contact with the conveyor belt 21. The respective photoconductive drums 61*y*, 61*m*, 61*c*, and 61*k* are rotated at predetermined speed by a not-shown motor.

The respective photoconductive drums 61*y*, 61*m*, 61*c*, and 61*k* are disposed such that axes thereof are spaced apart from one another at equal intervals and the axes are orthogonal to the direction in which the images are conveyed by the conveyor belt 21. In the following explanation, an axial direction of the respective photoconductive drums 61*y*, 61*m*, 61*c*, and 61*k* is set as a main scanning direction (a second direction) and a rotation direction of the photoconductive drums 61*y*, 61*m*, 61*c*, and 61*k*, i.e., a rotation direction of the conveyor belt 21 (the arrow "a" direction in the figure) is set as a sub-scanning direction (a first direction).

Around the respective photoconductive drums 61*y*, 61*m*, 61*c*, and 61*k*, charging devices 62*y*, 62*m*, 62*c*, and 62*k* serving as charging means extended in the main scanning direction, charge removing devices 63*y*, 63*m*, 63*c*, and 63*k*, developing rollers 64*y*, 64*m*, 64*c*, and 64*k* serving as developing means also extended in the main scanning direction, lower agitation rollers 67*y*, 67*m*, 67*c*, and 67*k*, upper agitation rollers 68*y*, 68*m*, 68*c*, and 68*k*, transferring devices 93*y*, 93*m*, 93*c*, and 93*k* serving as transferring means also extended in the main scanning direction, cleaning blades 65*y*, 65*m*, 65*c*, and 65*k* also extended in the main scanning direction, and waste toner collection screws 66*y*, 66*m*, 66*c*, and 66*k* are arranged in order along the rotation direction of the photoconductive drums 61*y*, 61*m*, 61*c*, and 61*k*.

The respective transferring devices 93*y*, 93*m*, 93*c*, and 93*k* are disposed in positions where the conveyor belt 21 is held between the transferring devices and the photoconductive drums 61*y*, 61*m*, 61*c*, and 61*k* corresponding to the transferring devices, i.e., on the inner side of the conveyor belt 21. Exposure points of exposure by an exposing device 50 are formed on outer peripheral surfaces of the photoconductive drums 61*y*, 61*m*, 61*c*, and 61*k* between the charging devices 62*y*, 62*m*, 62*c*, and 62*k* and the developing rollers 64*y*, 64*m*, 64*c*, and 64*k*, respectively.

Below the conveying mechanism 20, sheet cassettes 22*a* and 22*b* in which plural sheets P serving as image formation media, onto which images formed by the respective image forming units 10*y*, 10*m*, 10*c*, and 10*k* are transferred, are stored are arranged.

Pickup rollers 23*a* and 23*b* that take out the sheets P stored in the sheet cassettes 22*a* and 22*b* one by one from the top are arranged at one ends of the sheet cassettes 22*a* and 22*b* and on a side close to the driven roller 92. Register rollers 24 for aligning the leading end of the sheet P taken out from the sheet cassettes 22*a* and 22*b* and the leading end of a "y" toner image formed on the photoconductive drum 61*y* of the image forming unit 10*y* are arranged between the pickup rollers 23*a* and 23*b* and the driven roller 92.

Toner images formed on the other photoconductive drums 61*y*, 61*m*, and 61*c* are supplied to respective transfer positions to be timed to coincide with conveyance timing of the sheet P conveyed on the conveyor belt 21.

An attracting roller 26 for imparting an electrostatic attracting force to the sheet P conveyed at predetermined timing via the registration rollers 24 is disposed between the registration rollers 24 and the first image forming unit 10*y* and near the driven roller 92, i.e., substantially on the outer peripheral of the driven roller 92 across the conveyer belt 21. An axis of the attracting roller 26 and an axis of the driven roller 92 are set to be parallel to each other.

A positional deviation sensor 96 for detecting a position of an image formed on the conveyor belt 21 is disposed at one end of the conveyor belt 21 and near the driving roller 91, i.e., substantially on the outer periphery of the driving roller 91 across the conveyor belt 21.

The positional deviation sensor 96 is constituted by, for example, a transmissive or reflective optical sensor.

A conveyor belt cleaning device 95 for removing a toner adhering on the conveyor belt 21, paper dust of the sheet P, or the like is disposed on the outer periphery of the driving roller 91 and on the conveyor belt 21 on the downstream side of the positional deviation sensor 96.

A fixing device 80 that melts a toner image transferred onto the sheet P by heating the sheet P to a predetermined temperature and fixes the toner image on the sheet P is disposed in a direction in which the sheet P conveyed via the conveyor belt 21 is separated from the driving roller 91 and further conveyed. The fixing device 80 includes a heat roller pair 81, oil applying rollers 82 and 83, a web winding roller 84, a web roller 85, and a web pressing roller 86. On the downstream side of the fixing device 80 in the sheet conveyance direction, a color sensor 70 for optically reading an image formed on a sheet (in particular, a gradation pattern image and a gray halftone image described later) is arranged. The sheet P having the toner image heated and fixed thereon by the fixing device 80 is discharged by a paper discharge roller pair 87.

The exposing device 50 that forms electrostatic latent images subjected to color separation on the outer peripheral surfaces of the respective photoconductive drums 61*y*, 61*m*, 61*c*, and 61*k* has a semiconductor laser oscillator 60 controlled to emit light on the basis of image data (Y, M, C, and K) of respective colors subjected to color separation by an image processing device 36 described later. A polygon mirror 51 that reflects laser beams and uses the laser beams for scanning and is rotated by a polygon motor 54 and fθ lenses 52 and 53 for correcting focuses of the laser beams reflected via the polygon mirror 51 and focusing the laser beams are provided in order on an optical path of the semiconductor laser oscillator 60.

First return mirrors 55*y*, 55*m*, 55*c*, and 55*k* that bend the laser beams of the respective colors transmitted through the fθ lens 53 toward exposure positions of the respective photoconductive drums 61*y*, 61*m*, 61*c*, and 61*k*, and second and third return mirrors 56*y*, 56*m*, 56*c*, 57*y*, 57*m*, and 57*c* that further bend the laser beams bent by the first return mirrors 55*y*, 55*m*, and 55*c* are arranged between the fθ lens 53 and the respective photoconductive drums 61*y*, 61*m*, 61*c*, and 61*k*.

The laser beam for black is returned by the first return mirror 55*k* and then guided onto the photoconductive drum 61*k* without passing through the other mirrors.

Figure 2:
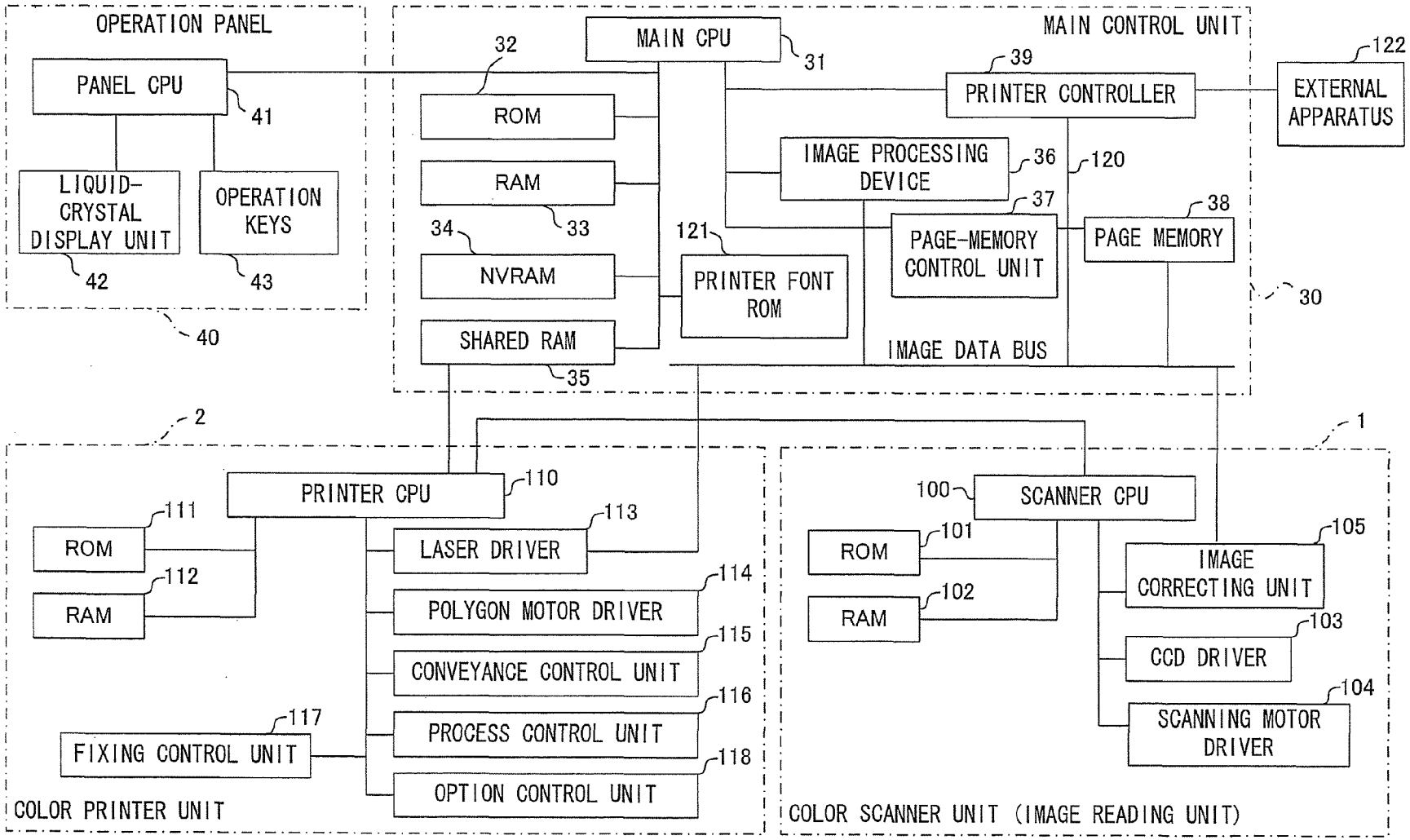
FIG. 2 is a block diagram schematically showing a flow of a signal for electric connection and control of the digital copying machine shown in FIG. 1.

FIG. 2 is a block diagram schematically showing a flow of a signal for electric connection and control of the digital copying machine shown in FIG. 1. In FIG. 2, a control system includes three CPUs, namely, a main CPU (central processing unit) 91 in a main control unit 30, a scanner CPU 100 of the color scanner unit 1, and a printer CPU 110 of the color printer unit 2.

The main CPU 91 performs bidirectional communication with the printer CPU 110 via a shared RAM (random access memory) 35. The main CPU 91 issues an operation instruction and the printer CPU 110 returns a status. The printer CPU 110 and the scanner CPU 100 perform serial communication. The printer CPU 110 issues an operation instruction and the scanner CPU 100 returns a status.

An operation panel 40 has a liquid-crystal display unit 42, various operation keys 43, and a panel CPU 41 connected to the liquid-crystal display unit 42 and the operation keys 43. The operation panel 40 is connected to the main CPU 91.

The main control unit 30 includes the main CPU 91, a ROM (read only memory) 32, a RAM 33, an NVRAM 34, the shared RAM 35, the image processing device 36, a page-memory control unit 37, a page memory 38, a printer controller 39, and a printer font ROM 121.

The main CPU 91 manages overall control. The ROM 32 has stored therein a control program and the like. The RAM 33 temporarily stores data.

The NVRAM (nonvolatile RAM) 34 is a nonvolatile memory backed up by a battery (not shown) and holds stored data even if a power supply is isolated.

The shared RAM 35 is used for performing bidirectional communication between the main CPU 91 and the printer CPU 110.

The page-memory control unit 37 stores image information in the page memory 38 and reads out the image information from the page memory 38. The page memory 38 has an area in which image information for plural pages can be stored. The page memory 38 is formed to be capable of storing, for each page, data obtained by compressing image information from the color scanner unit 1.

Font data corresponding to print data is stored in the printer font ROM 121. The print controller 39 expands printer data from an external apparatus 122 such as a personal computer into image data using the font data stored in the printer font ROM 121 at a resolution corresponding to data indicating a resolution given to the printer data.

The color scanner unit 1 includes the scanner CPU 100 that manages overall control, a ROM 101 having stored therein a control program and the like, a RAM 102 for data storage, a CCD driver 103 that drives the color image sensor 15, a scanning motor driver 104 that controls rotation of a scanning motor for moving the first carriage 8 and the like, and an image correcting unit 105.

The image correcting unit 105 includes an A/D conversion circuit that converts analog signals of R, G, and B outputted from the color image sensor 15 into digital signals, respectively, a shading correction circuit for correcting fluctuation in a threshold level with respect to an output signal from the color image sensor 15 due to variation in the color image sensor 15 or an ambient temperature change, and a line memory that temporarily stores a digital signal subjected to shading correction from the shading correction circuit.

The color printer unit 2 includes the printer CPU 110 that manages overall control, a ROM 111 having stored therein a control program and the like, a RAM 112 for data storage, a laser driver 113 that drives the semiconductor laser oscillator 60, a polygon motor driver 114 that drives the polygon motor 54 of the exposing device 50, a conveyance control unit 115 that controls the conveyance of the sheet P by the conveying mechanism 20, a process control unit 116 that controls processes for performing charging, development, and transfer using the charging device, the developing roller, and the transferring device, a fixing control unit 117 that controls the fixing device 80, and an option control unit 118 that controls options.

The image processing unit 36, the page memory 38, the printer controller 39, the image correcting unit 105, and the laser driver 113 are connected by an image data bus 120.

Figure 3:
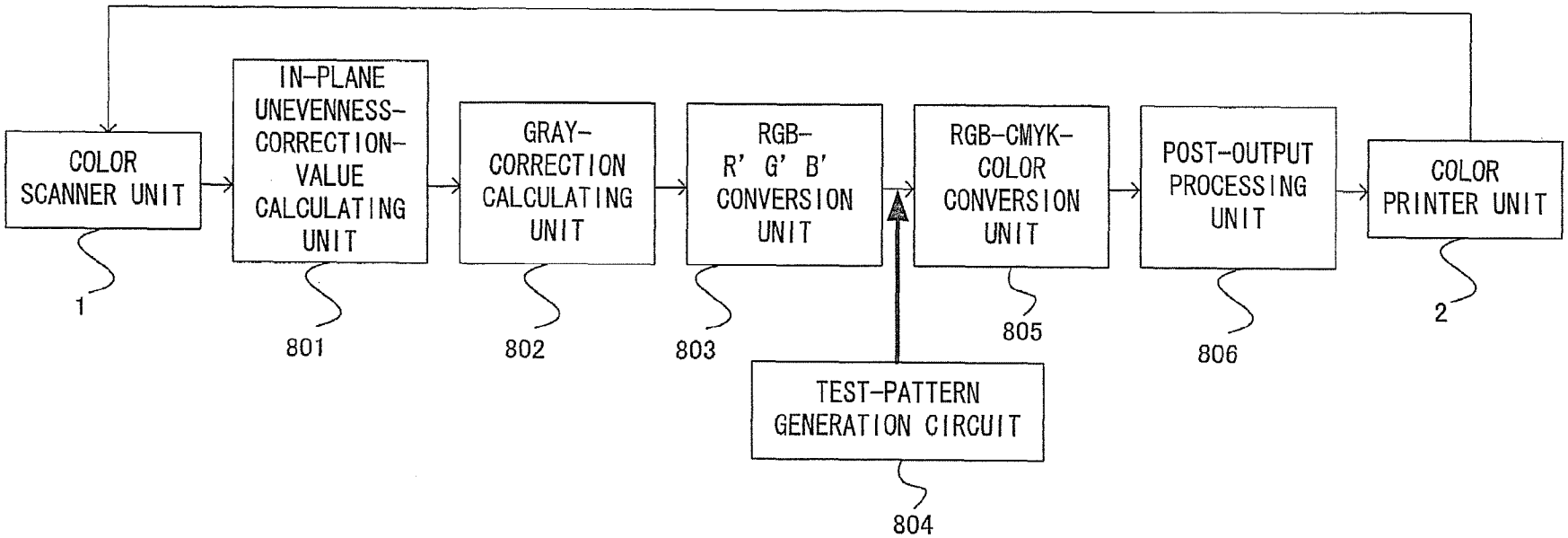
FIG. 3 is a diagram showing functional blocks of the image forming apparatus according to the embodiment.

FIG. 3 is a diagram showing functional blocks of the image forming apparatus according to this embodiment. The image forming apparatus according to this embodiment forms, on a sheet, a test pattern formed by a color obtained by mixing colors of toners of plural colors, reads a test pattern image formed on the sheet with a color sensor, and performs predetermined image adjustment processing on the basis of information read.

As shown in the figure, the image forming apparatus according to this embodiment includes a color scanner unit 1, an in-plane unevenness-correction-value calculating unit 801, a gray-correction calculating unit 802, an RGB-R'G'B' conversion unit 803, a test-pattern generation circuit 804, an RGB-CMYK-color conversion unit 805, a post-output processing unit 806, and a color printer unit 2.

In the image forming apparatus according to this embodiment, for example, a flow of operations is as described below.

First, the test-pattern generation circuit 804 generates a test pattern for gamma correction (predetermined image adjustment processing). The test pattern does not always have to be generated. It is also possible to acquire a test pattern stored in a predetermined memory area in advance. The test pattern generated as described above is converted into a CMYK image by the RGB-CMYK-color conversion unit 805 and formed on a sheet by the color printer unit 2 via the post-output processing unit 806. The test-pattern generation circuit 804, the RGB-CMYK-color conversion unit 805, and the post-output processing unit 806 are equivalent to a halftone-image forming unit.

Figure 4:
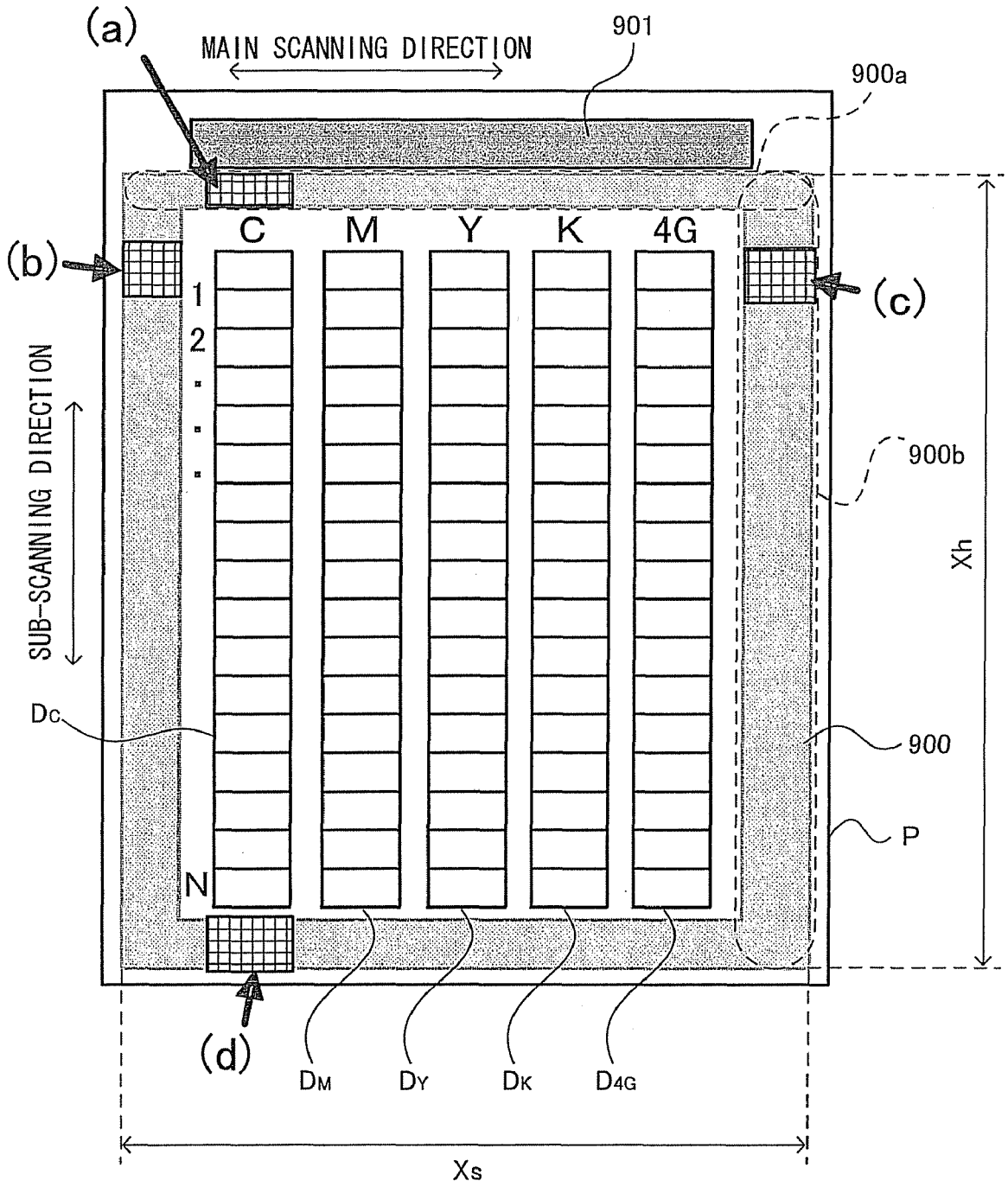
FIG. 4 is a diagram showing an example of a test pattern outputted by a color printer unit.

FIG. 4 is a diagram showing an example of a test pattern outputted by the color printer unit. As shown in the figure, a test pattern used for execution of gamma correction processing is printed on an identical sheet together with a first halftone image 900*a* extending over a predetermined range Xs in the main scanning direction and a second halftone image 900*b* extending over a predetermined range Xh in the sub-scanning direction.

The "test pattern" is formed by four patterns of a gradation patch $D_Y$ formed by a yellow toner, a gradation patch $D_M$ formed by a magenta toner, a gradation patch $D_C$ formed by a cyan toner, a gradation patch $D_K$ formed by a black toner, and a gradation patch $D_{4G}$ formed by mixing colors of toners of yellow, magenta, cyan, and black. The gradation patch $D_{4G}$ is formed by an image subjected to inking processing of normal copy or print processing.

These gradation patterns are formed such that densities of gradation patterns change in the sheet conveyance direction (the sub-scanning direction). A black bar 901 for automatically discriminating positions of gradation patches on the sheet P is formed at the front of these four gradation patterns.

It is preferable that the "halftone image" is a gray halftone image having substantially uniform density formed by mixing colors of toners of yellow, magenta, cyan, and black. In order to determine states of toner density unevenness in the main scanning direction and the sub-scanning direction in a range as wide as possible, a gray halftone image is arranged around a test pattern and an entire range in which it is possible to form an image on a sheet is set as the predetermined range. However, it is also possible to set the predetermined range in an area smaller than this as required.

In performing color printing, since it is normal to mix and use colors of toners of all of colors YMCK for an achromatic image, it is possible to perform image adjustment processing such as gamma correction having a print condition close to an actual print condition and higher reproducibility by performing image adjustment processing on the basis of a gray image formed by mixing colors of toners of YMCK. By forming the gray halftone image obtained by mixing colors of toners of all colors YMCK, it is possible to determine, in one print processing, states of image formation characteristics of respective processing units that form respective toner images of the four colors. By printing the gray halftone image for determination of density unevenness and the test pattern for determination of a gamma characteristic on an identical sheet (printing the gray halftone image and the test pattern under print conditions in which temperature conditions, timings, counter values, and the like thereof are closer to each other), it is possible to perform more highly accurate gamma correction.

Subsequently, the color scanner unit 1 (or the color sensor 70) (equivalent to an image reading unit) reads the test pattern and the gray halftone image printed on the sheet as described above.

The in-plane unevenness-correction-value calculating unit (the density-unevenness determining unit) 801 determines, on the basis of reading data of the gray tone image read as described above, toner density unevenness in an image formed by the image forming apparatus.

Specifically, the in-plane unevenness-correction-value calculating unit 801 acquires, for example, a toner density of a first patch region from the top in the gradation patch $D_C$ shown in FIG. 4 on the basis of reading data of gray halftone images of sections (a) to (d) shown in FIG. 4. In this way, the in-plane unevenness-correction-value calculating unit 801 calculates a toner density unevenness correction value for correcting toner density unevenness in the main scanning direction and the sub-scanning direction in all the gradation patches $D_C$ to $D_{4G}$.

The gray-correction calculating unit 802 calculates an average density of respective patch regions forming the respective gradation patterns for the gradation patches $D_{4G}$ and $D_K$. The gray-correction calculating unit 802 corrects the average density value with the toner density unevenness correction value calculated by the in-plane unevenness-correction-value calculating unit 801.

Figure 5:
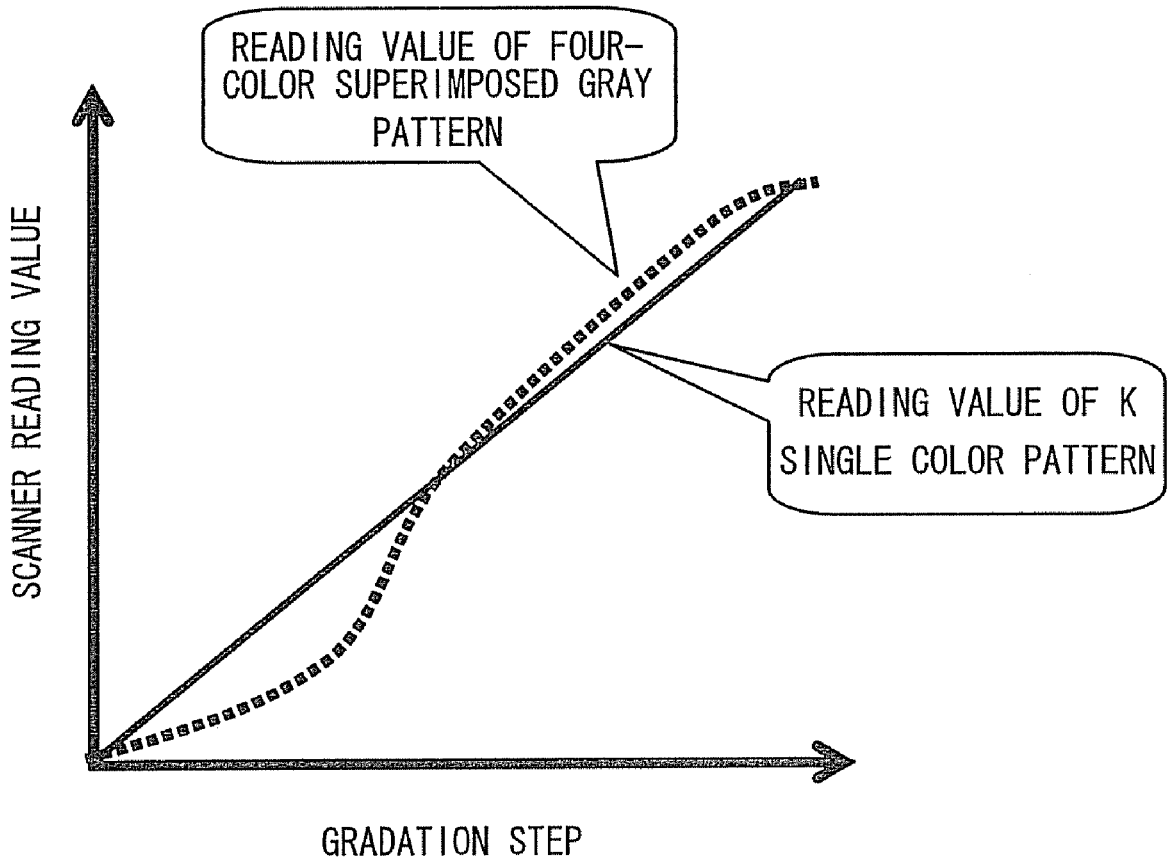
FIG. 5 is a diagram for explaining gray correction.

Subsequently, the gray-correction calculating unit 802 calculates a correction approximation formula according to the least square method or the like such that densities of the respective patch regions in the gradation patch $D_{4G}$ are the same as those of the respective patch regions in the gradation patch $D_K$ (see FIG. 5).

A correction value calculated by the gray-correction calculating unit 802 in this way is set in the RGB-R'G'B' conversion unit 803 and predetermined image adjustment processing is performed on the basis of the density unevenness determined by the in-plane unevenness-correction-value calculating unit 801. The RGB-R'G'B' conversion unit 803 alone or the RGB-R'G'B' conversion unit 803 and a functional unit that executes processing related to the gamma correction processing are equivalent to an image-adjustment processing unit. Since the gamma correction processing itself is the publicly-known technique, an explanation about the functional unit that executes the gamma correction processing is omitted.

Figure 6:
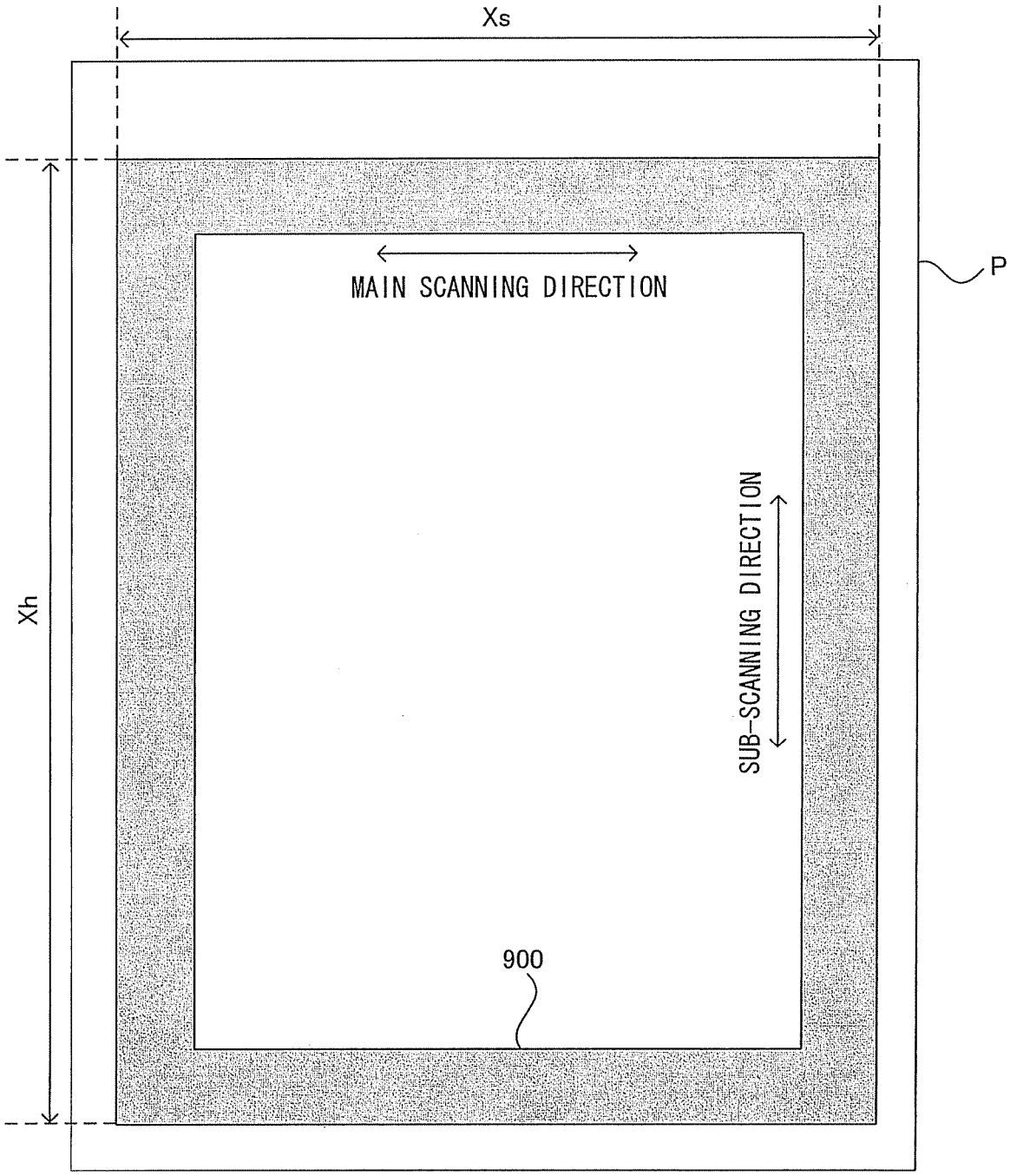
FIG. 6 is a diagram showing another example of a gray halftone image used in the image forming apparatus according to the embodiment.
Figure 7:
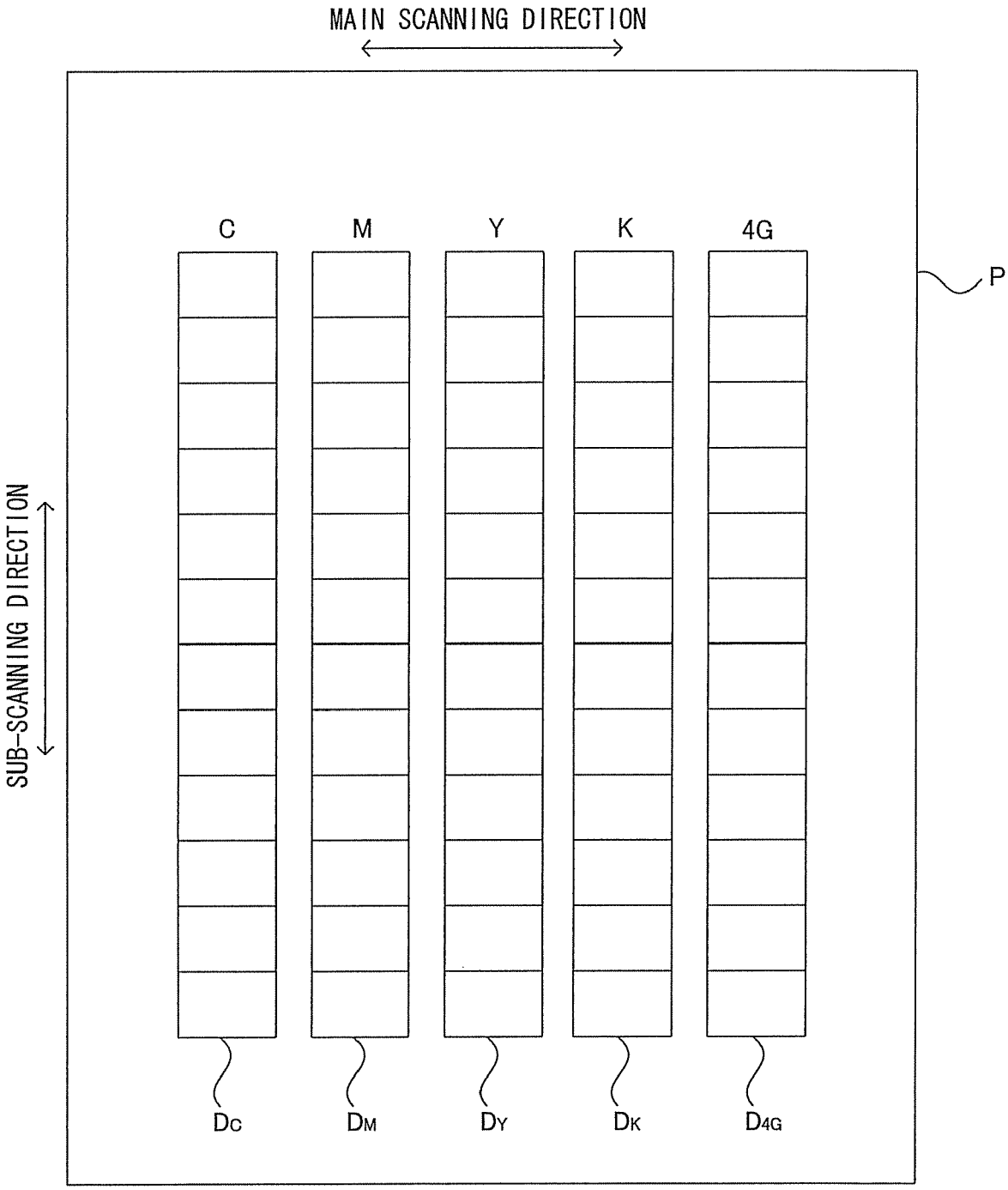
FIG. 7 is a diagram showing another example of a test pattern used in the image forming apparatus according to the embodiment.

FIG. 6 is a diagram showing another example of the gray halftone image used in the image forming apparatus according to this embodiment. FIG. 7 is a diagram showing another example of the test pattern used in the image forming apparatus according to this embodiment. In the example shown in FIG. 4, the test pattern and the gray halftone image are formed on the identical sheet. However, the invention is not limited to this. It is also possible to, first, read a sheet on which a gray halftone image 900 shown in FIG. 6 is formed with a scanner, grasp a state of toner density unevenness in advance, and, then, read a test pattern image shown in FIG. 7 with the scanner to perform image adjustment processing. In this case, it is preferable to form the gray halftone image shown in FIG. 6 and the test pattern shown in FIG. 7 on the sheet at timings as close as possible.

Figure 8:
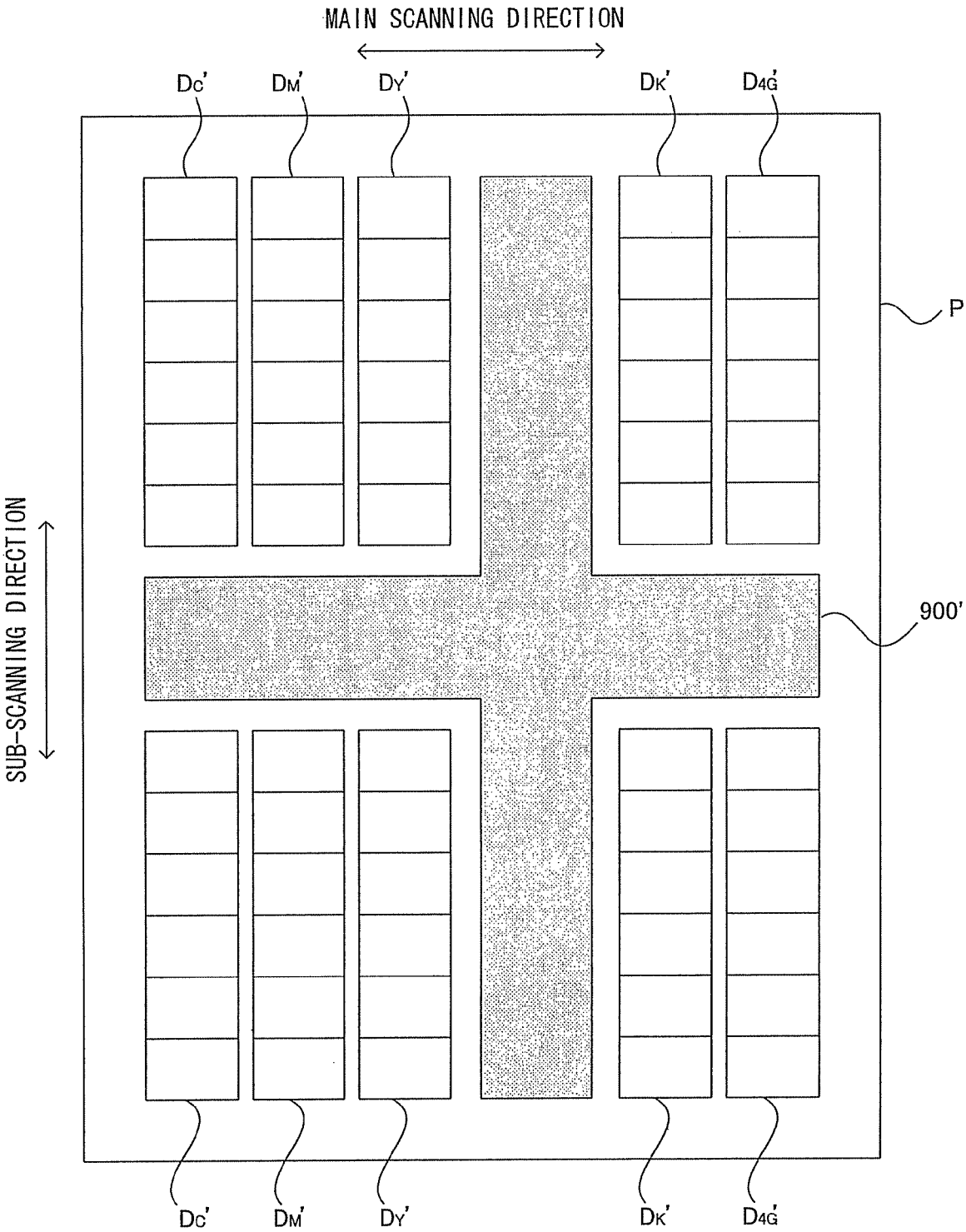
FIG. 8 is a diagram showing still another example of the test pattern and the gray halftone image used in the image forming apparatus according to the embodiment.

FIG. 8 is a diagram showing still another example of the test pattern and the gray halftone image used in the image forming apparatus according to this embodiment. In the example shown in FIG. 4, the gray halftone images are arranged around the test pattern. However, the invention is not limited to this. As shown in FIG. 8, a halftone image may be arranged on the inner side of a test pattern. When it is desired to grasp toner density unevenness near four corners of a sheet, halftone images may be formed near the four corners of the sheet.

Figure 9:
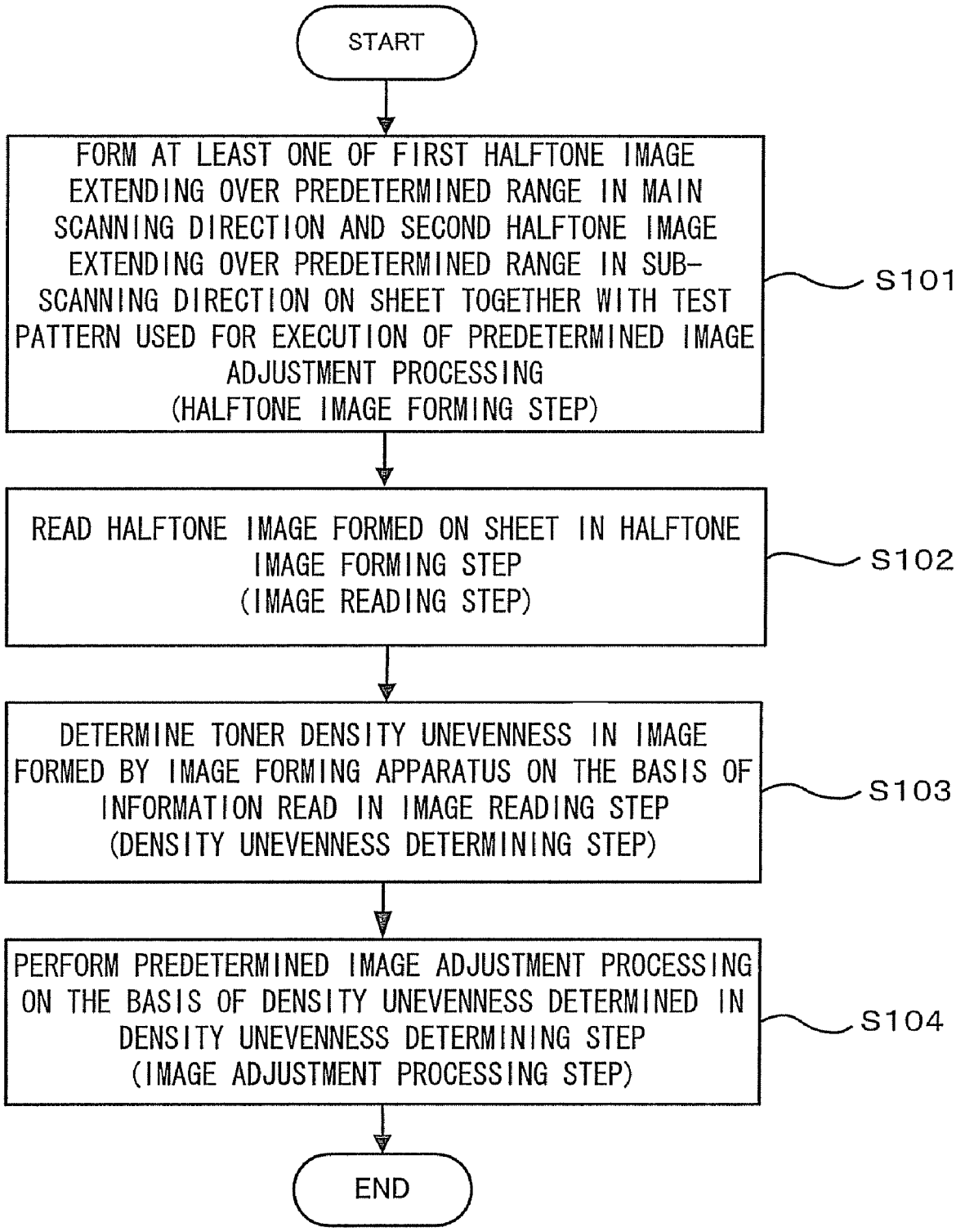
FIG. 9 is a flowchart for explaining a flow of processing (an image adjusting method) in the image forming apparatus according to the embodiment.

FIG. 9 is a flowchart for explaining a flow of processing (an image adjusting method) in the image forming apparatus according to this embodiment.

The halftone-image forming unit forms, on a sheet, at least one of a first halftone image extending over a predetermined range in the main scanning direction and a second halftone image extending over a predetermined range in the sub-scanning direction together with a test pattern used for execution of predetermined image adjustment processing (a halftone image forming step) (S101). In this case, it is preferable that, in the halftone image forming step, the halftone image is formed on the sheet to be arranged around the test pattern used for execution of the predetermined image adjustment processing.

The color scanner unit 1 reads the halftone image formed on the sheet in the halftone image forming step (an image reading step) (S102).

The density-unevenness determining unit determines, on the basis of information read in the image reading step, toner density unevenness in an image formed by the image forming apparatus (a density unevenness determining step) (S103).

The image-adjustment processing unit performs the predetermined image adjustment processing on the basis of the density unevenness determined in the density unevenness determining step (an image adjustment processing step) (S104).

The respective steps in the processing (the image adjusting method) in the image forming apparatus are realized by causing the CPUs (the main CPU 31, the panel CPU 41, the scanner CPU 100, and the printer CPU 110) to execute an image adjusting program stored in the memories (the ROM 32, the RAM 33, the ROM 101, the RAM 102, the ROM 111, the RAM 112, the NVRAM 34, and the shared RAM 35).

In the explanation of this embodiment, the function of carrying out the invention is recorded in the apparatus in advance. However, the invention is not limited to this. The same function may be downloaded from a network to the apparatus or the same function stored in a recording medium may be installed in the apparatus. A form of the recording medium may be any form as long as the recording medium is a recording medium that is capable of storing a program and readable by the apparatus such as a CD-ROM. The function obtained by installation or download in advance in this way may be realized in cooperation with an OS (operating system) and the like in the apparatus.

In the example explained in the embodiment, a record medium on which an image is formed is a copy sheet and the like. However, the invention is not limited to this. Any sheet may be adopted as long as the sheet is a sheet on which it is possible to form an image such as a cardboard and an OHP film.

As described above, in this embodiment, in a copy or print image of a color MFP, toner density unevenness in an identical sheet is corrected and then a gray balance is automatically adjusted. In other words, in order to correct an influence of the density unevenness on the identical sheet, values of four-color superimposed halftones added in four places around a correction pattern of a copy or a printer are read, in-plane unevenness of the respective colors is corrected, and a Y/M/C/K-four-color superimposed gray section is automatically adjusted. In the adjustment, since the gray section is corrected to have a value equal to a value of a section outputted with a single color K, even an image in which a section printed with the single color K is mixed can be reproduced without a sense of incongruity of colors.

The invention has been explained in detail using the specific form. However, it would be obvious for those skilled in the art that various alterations and modifications can be made without departing from the spirit and the scope of the invention.

As described above in detail, according to the invention, it is possible to provide a technique that can stably realize highly accurate image adjustment processing even when unexpected toner density unevenness occurs on an identical sheet because of fluctuation in an image formation characteristic and the like.

What is claimed is:

1. An image forming apparatus comprising:

a test pattern generation unit configured to form, on a sheet, a test pattern formed by a color obtained by mixing colors of toners of plural colors, the test pattern being used for predetermined image adjustment processing; and a halftone-image forming unit configured to form, on the sheet, a halftone image used for determination of density unevenness and extending in a main scanning direction and in a sub-scanning direction, the halftone image being arranged surrounding the test pattern.

2. An image forming apparatus comprising:

a test pattern generation unit configured to form, on a sheet, a plurality of test patterns with different respective colors using toners, the test patterns being used for predetermined image adjustment processing; and a halftone-image forming unit configured to form, on the sheet, a halftone image used for determination of density unevenness and extending in a main scanning direction and in a sub-scanning direction, the halftone image being arranged surrounding a collection of the plurality of test patterns.

3. An image forming apparatus according to claim 2, wherein the halftone image is a gray halftone image having substantially uniform density formed by mixing colors of toners of yellow, magenta, cyan, and black.

4. An image forming apparatus according to claim 2, wherein the plurality of test patterns with different respective colors are gradation patterns with respective single colors of yellow, magenta, cyan, and black.

5. An image forming apparatus according to claim 2, wherein the plurality of test patterns with different respective colors are gradation patterns with respective single colors of yellow, magenta, cyan, and black and gradation patterns with mixed colors of yellow, magenta, cyan, and black.

6. An image forming apparatus according to claim 2, wherein the predetermined image adjustment processing is gamma correction processing.

7. An image forming apparatus comprising:

a test pattern generation unit configured to form, on a sheet, a plurality of test patterns with different respective colors using toners, the test patterns being used for predetermined image adjustment processing, the test patterns being arranged side by side; and a halftone-image forming unit configured to form, on the sheet, a cross-shaped halftone image used for determination of density unevenness and extending in a main scanning direction and in a sub-scanning direction, the halftone image being arranged on an inner side of the plurality of test patterns.

8. An image forming apparatus comprising:

a test pattern generation means configured to form, on a sheet, a plurality of test patterns with different respective colors using toners, the test patterns being used for predetermined image adjustment processing; and a halftone-image forming means configured to form, on the sheet, a halftone image used for determination of density unevenness and extending in a main scanning direction and in a sub-scanning direction, the halftone image being arranged surrounding a collection of the plurality of test patterns.

9. An image forming apparatus according to claim 8, wherein the halftone image is a gray halftone image having substantially uniform density formed by mixing colors of toners of yellow, magenta, cyan, and black.

10. An image forming apparatus according to claim 8, wherein the plurality of test patterns with different respective colors are gradation patterns with respective single colors of yellow, magenta, cyan, and black.

11. An image forming apparatus according to claim 8, wherein the plurality of test patterns with different respective colors are gradation patterns with respective single colors of yellow, magenta, cyan, and black and gradation patterns with mixed colors of yellow, magenta, cyan, and black.

12. An image forming apparatus according to claim 8, wherein the predetermined image adjustment processing is gamma correction processing.

13. An image forming apparatus comprising:

a test pattern generation means configured to form, on a sheet, a plurality of test patterns with different respective colors using toners, the test patterns being used for predetermined image adjustment processing, the test patterns being arranged side by side; and a halftone-image forming means configured to form, on the sheet, a cross-shaped halftone image used for determination of density unevenness and extending in a main scanning direction and in a sub-scanning direction, the halftone image being arranged on an inner side of the plurality of test patterns.

* * * * *